US005189897A

United States Patent [19]

Lionetti et al.

[11] Patent Number: 5,189,897

[45] Date of Patent: Mar. 2, 1993

[54] METHOD AND APPARATUS FOR WIRE DRAWING

[75] Inventors: Robert E. Lionetti, Wadsworth; Patrick E. Joseph, Akron; Dong K. Kim, Akron; Farrel B. Helfer, Akron, all of Ohio

[73] Assignee: The Goodyear Tire & Rubber Company, Akron, Ohio

[21] Appl. No.: 776,948

[22] Filed: Oct. 15, 1991

[51] Int. Cl.[5] ..... B21C 1/04

[52] U.S. Cl. ..... 72/278; 72/280; 72/281

[58] Field of Search ..... 72/278, 280, 281, 282, 72/274

[56] References Cited

U.S. PATENT DOCUMENTS

| | | | |
|---|---|---|---|
| 2,715,959 | 8/1955 | Zelley . | |
| 3,299,687 | 1/1967 | Kneip | 72/278 |
| 3,486,361 | 12/1969 | Vaneman et al. . | |
| 3,664,169 | 5/1972 | Henrich . | |
| 3,955,390 | 5/1976 | Geary | 72/278 |
| 4,960,473 | 10/1990 | Kim et al. . | |

OTHER PUBLICATIONS

"Delamination of Hard Drawn Eutectoid Steel Wires" by Browrigg et al, pub. in Advances in Fracture Research vol. 2, New Dehli, India, Dec. 1984.

"Making Quality Steel Wire at Optimum Productivity" by Zimmerman et al., published in Wire Journal International, Aug. 1989.

"Materials Response to Withdrawing" by Aernoudt, published Wire Journal International, Mar. 1989.

"Strain Aging in Cold Drawn Wire" by Lanner, published in Springs, vol. 22, May 1983.

*Primary Examiner*—Daniel C. Crane

*Attorney, Agent, or Firm*—T. P. Lewnadowski

[57] ABSTRACT

A method and apparatus for drawing steel wire to produce high tensile strength, steel wire with increased torsional ductility. The wire is drawn through a plurality of standard dies (14) in a wire drawing machine (10). The cross section of the wire is reduced by a constant reduction of about 15% to about 18% at each of the standard dies (14) with the exception of the final two dies (18, 19). The wire is then reduced by about 10% to about 90% of the typical reduction at the next to last die (18) and the remainder of the reduction at the final die (19).

16 Claims, 4 Drawing Sheets

METHOD AND APPARATUS FOR WIRE DRAWING

While the invention is subject to a wide range of applications, it is particularly suited for drawing metal wire into high tensile strength, steel wire with increased torsional ductility. In particular, wire is drawn through a plurality of dies in a wire drawing machine whereby the cross section of the wire is reduced by a constant reduction at each die. The total reduction at the final two dies is equal to the constant reduction. The wire is reduced by about 10% to about 90% of the typical reduction at the next to last die and the remainder of the reduction at the final die.

The hardness of drawn steel wire results from the plastic deformation associated with the drawing process. The wire increases in hardness as it proceeds through the wire drawing machine. If the wire becomes too hard or brittle, breakage occurs during the drawing process or when the wire is subjected to torsion or bending.

The process mechanics of drawing wire are discussed in an article, "DRAWING FINE WIRE ON WET WIREDRAWING MACHINES" by Zimmerman, et al., WIRE JOURNAL INTERNATIONAL, August 1988. As the wire is drawn through a die to reduce its cross section, the outer fibers of the wire flow faster or at a higher velocity than those in its center causing a lesser amount of elongation at the center of the wire than at the surface of the wire. A stress differential resulting from this mechanism of elongation induces compressive, longitudinal stresses on the surface of the wire and tensile, longitudinal stresses at its center. Voids, known as central bursts, can occur in the center of the wire when the tensile stresses exceed the breaking strength of the material. The central burst effect can be prevented by controlling the process geometries. That is, the die angle and the percent reduction in area are selected to avoid the "Central Bursting Zone" illustrated in FIG. 3 of the present drawings. The central bursting zone defines die geometries for which non-uniform deformation through the cross section of the wire is expected. Die geometries defining the central bursting zone do not always result in central bursting. These geometries will, however, always induce the tensile, longitudinal stresses in the wire center and the compressive, longitudinal stresses at the wire surface that can cause voids and fracture during subsequent drawing steps or when the drawn wire is subjected to torsional loading.

Strain introduced into the wire by the drawing process increases the tensile strength of the wire. Preferably, this increase is held constant at every die of the draft in a wire drawing machine. Analyses of the formation of central bursts show that bursting is more likely to occur if the increase in tensile strength remains low. Therefore, the wire is drawn through a draft of many dies each having a geometry to avoid the central burst zone. Reducing the number of dies in the draft results in a higher reduction of area at each die. This in turn results in an increase in both the heat generated and die wear. To obviate these problems, the wire drawing industry is continually trying to improve the quality of wire drawn products. An ongoing search, therefore, continues for improvements in processing and/or equipment design to economically manufacture wire, such as high tensile strength wire.

Wire drawing machines are typically designed to draw wire through a draft of nineteen to twenty-one dies. For example, the article by Zimmerman, et al., evaluates data of a 1.1 millimeters (mm.) diameter wire drawn to a 0.22 mm. diameter through nineteen dies each having 12 degree included angles. The reduction at each step was about 16%. This reduction was just below the curve in the central bursting zone, as illustrated in the graph of FIG. 3 herein. At first glance, increasing the reduction in area of wire at a die increases the speed of manufacture and reduces the number of dies needed to draw the wire to a desired size. The increase in reduction is particularly advantageous because it reduces the central bursting zone effect. Other parameters, however, such as an increase in heat generation and die wear prevent the selection of an increased reduction in area for a given included die angle. Contrarily, reducing the area by a significant amount to overcome the latter problems and improve the economics of the process, leads to a high probability of central bursting.

Ductility of high strength, steel wire is particularly important when the wire is subjected to plastic deformation during manufacture, such as from twisting a plurality of wires into a multi-wire strand. Torsion testing, indicating the minimum number of twists to failure, is a common method of testing wire ductility. Maximum ductility occurs when there is uniform twisting along a gauge length and the final fracture is straight and transverse to the wire axis. Strain localization and delamination (longitudinal splitting) are qualitative indications of a decrease in ductility, ie., fewer number of twists to failure. The article "DELAMINATION OF HARD DRAWN EUTECTOID STEEL WIRES" by Brownrigg, et al., ADVANCES IN FRACTURE RESEARCH (FRACTURE 84), Volume 2, Pergamom Press Ltd. December 1984, states that strain aging is a primary cause of delamination. Dynamic strain aging (DSA) occurs as the wire temperature increases during drawing due to larger reductions at each die, increased drawing speed or a greater total reduction. DSA results in an increased tensile strength and a decreased tensile ductility relative to the reduction in area. Lowering the DSA by decreasing the reduction of area at a die does not seem to provide increased ductility. The literature, ie., Zimmerman, et al., cited before, indicates that such measures lead to central bursting.

It is desirable to provide a method and apparatus to draw high tensile strength, steel wire that has increased torsional ductility.

It is an advantage of the present invention to provide an apparatus and method of drawing steel wire that obviates one or more of the limitations and disadvantages of the described prior arrangements.

It is a further advantage of the present invention to provide an apparatus and method of drawing steel wire to produce high tensile strength, steel wire with increased torsional ductility.

It is a still further advantage of the present invention to produce high tensile strength, steel wire with increased torsional ductility by a relatively inexpensive method and apparatus.

In accordance with the invention, there is provided method and apparatus for drawing steel wire through a plurality of dies and drawing capstans alternately arranged in a wire drawing machine. The cross section of the wire is typically reduced by a reduction of about 15% to about 18% at all but the final two dies. The cross section of the wire at the final two dies is reduced by a total amount substantially equal to the reduction at a single standard die. The reduction at the next to final die is about 10% to about 90% of the typical reduction at a standard die with the remainder at the final die.

Also in accordance with the invention, steel wire is drawn through a plurality of standard dies and the reduction at the next to final die is preferably about 30% to about 70% of the typical reduction at the preceding dies with the remainder at the final die. Most preferably, the reduction at the next to final die is about 55% of the typical reduction and the remainder at the final die.

In accordance with another aspect of the invention, the wire is reduced at each of the plurality of standard dies by a typical reduction of about 15.5%. Both the standard dies and the final two dies have a die angle of about 12 degrees.

In accordance with the invention, a method of drawing steel wire to produce high tensile strength, steel wire with increased torsional ductility is diclosed. The method comprises the steps of drawing wire through a plurality of dies arranged in a wire drawing device; reducing the cross section of the wire by a constant reduction of about 15% to about 18% at each of the plurality of dies; and reducing the wire at a final die and a next to last die of said wire drawing device by a total amount to equal said constant reduction wherein the reduction at the next to last die is between about 10% to about 90% of the constant reduction and the remainder of the reduction is at the final die.

Further in accordance with the invention, an apparatus for drawing steel wire to produce high tensile strength, steel wire with increased torsional ductility, comprises a plurality of dies arranged in a wire drawing device; each of said plurality of dies reduces the cross section of the wire by a constant reduction of about 15% to about 18%; and a next to last die and a final die in said wire drawing device reducing the cross section of the wire by a total reduction substantially equal to the constant reduction, said next to last die reducing the cross section of the wire by a reduction of about 10% to about 90% of the constant reduction and the remainder of the cross section being reduced at said final die.

Also in accordance with the invention, as an article of manufacture, a high tensile strength, steel wire with increased torsional ductility formed by the method of drawing steel wire, comprising the steps of: drawing wire through a plurality of dies arranged in a wire drawing device; reducing the cross section of the wire by a constant reduction of about 15% to about 18% at each of the plurality of dies; and reducing the cross section of the wire at a next to last die and at a final die in said wire drawing device by a total reduction substantially equal to the constant reduction, said next to last die reducing the cross section of the wire by about 10% to about 90% of the constant reduction and the remainder of the cross section being reduced at said final die.

In a second embodiment of the invention, the cross section of the wire is typically reduced by a reduction of about 15% to about 18% at all but the final die. The wire reduction at the last die is between about 10% to about 90% of the typical reduction. Preferably, the reduction at the final die is about 30% to about 70% of the typical reduction and most preferably, the reduction at the final die is about 55% of the typical reduction.

In accordance with the second embodiment, a method of drawing steel wire to produce high tensile strength, steel wire with increased torsional ductility, comprises the steps of: drawing wire through a plurality of dies arranged in a wire drawing device; reducing the cross section of the wire by a constant reduction of about 15% to about 18% at each of the of the dies; and reducing the cross section of the wire at a final die by a reduction of about 10% to about 90% of the constant reduction.

Further in accordance with the second embodiment, an apparatus for drawing steel wire to produce high tensile strength, steel wire with increased torsional ductility, comprises: a plurality of dies in a wire drawing device; each of said plurality of dies reducing the cross section of the wire by a constant reduction of about 15% to about 18%; and a final die reducing the cross section of the wire by a reduction of about 10% to about 90% of the constant reduction.

The invention and further developments of the invention are now elucidated by preferred embodiments shown in the drawings.

Figure 1:
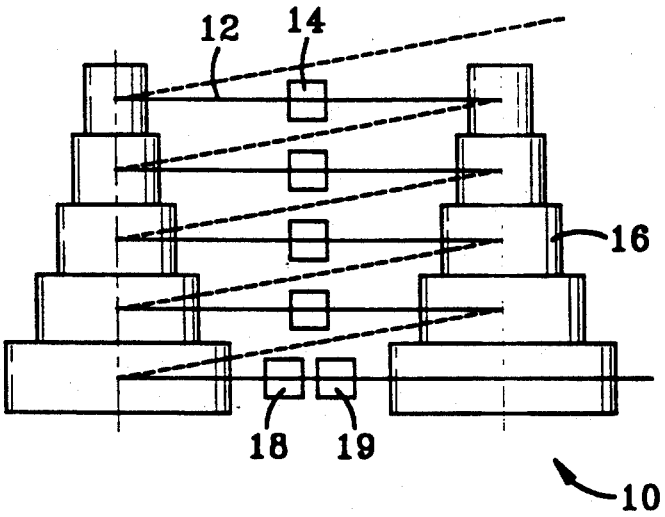
FIG. 1 is a schematic of drawing capstans and dies for drawing metal wire of the present invention.

Referring to FIG. 1, there is illustrated a wire drawing device 10 to produce high tensile strength, steel wire 12. A plurality of substantially identical, standard dies 14 and drawing capstans 16 are alternately arranged in device 10. The term "standard die", as used in the present specification and claims, refers to a die having a geometry that reduces the cross section of the wire a substantially constant amount equal to that of the other dies in a draft of the wire drawing device. The total reduction of the cross section of the wire at the final dies 18 and 19 of the device 10 is substantially equal to the reduction at each of the preceding, standard dies. The device 10 is preferably a wet, slip, wire drawing machine and the dies are submerged in a cooling lubricant.

The steel wire as used in the present specification and claims is preferably brass and or zinc-coated steel wire or filaments. The steel filaments have a very thin layer of brass, such as alpha brass, sometimes with the brass coating itself having a thin zinc layer thereon, or a ternary alloy addition, such as cobalt or nickel. The term "steel" refers to what is commonly known as carbon steel, also called high-carbon steel, ordinary steel, straight carbon steel and plain carbon steel. An example of such steel is American Iron and Steel Institute Grade 1070-high-carbon steel (AISI 1070). Such steel owes its properties chiefly to the presence of carbon without substantial amounts of other alloying elements. However, the tensile strength of carbon steel can be increased by small additions of alloying elements, usually less than 1.0%. These are called "micro-alloyed steels." High tensile strength steels having a high level of ductility and outstanding fatigue resistance are described in U.S. Pat. No. 4,960,473, which is incorporated herein by reference. Brass is an alloy of copper and zinc which can contain other metals in varying lesser amounts. The ternary alloys employed as coatings in this invention are iron-brass alloys since they contain 0.1 to 10 percent iron.

The wire 12 passes directly from each standard die 14 to its drawing capstan 16 and then to the next die. The wire is drawn over capstans 16 with each succeeding capstan running faster than the preceding one to compensate for wire elongation. The reduction in the cross sectional area of the wire between the capstans on this machine with a straight draft, is a substantially fixed or standard value. This insures a lower velocity of the wire being drawn than the peripheral velocity of the drawing capstans. The resulting positive slip insures that all portions of the wire are taut and that there is adequate frictional force exerted on the wire by the capstan to pull the wire through the dies. Without this force, the loads and subsequent positions in the wire drawing machine are excessive and wire breakage occurs.

The first embodiment, as illustrated in FIG. 1, reduces steel wire by a constant reduction of about 15% to about 18% at each standard die 14. Preferably, the cross section of the wire is reduced at each die 14 by a constant reduction of about 15.5%. The final two dies 18 and 19 are disposed between the last two capstans. An important aspect of the invention is that the total reduction of the cross section of the wire at the final two dies 18 and 19 is substantially equal to the reduction at one of the preceding, standard dies. Preferably, the reduction in the next to last die 18 is about 10% to about 90% of the constant reduction at the preceding, standard dies 14 and the remaining reduction is at the final die 19. More preferably, the reduction at next to final die 18 is about 30% to about 70% of the constant reduction and the remainder is at the final die 19. Most preferably, the reduction at the next to final die 18 is about 55% of the constant reduction and the remainder is at the final die 19. While FIG. 1 illustrates both dies 18 and 19 disposed between two capstans, it is within the scope of the invention to place each of the final two dies between separate capstans as with the standard dies.

Figure 2:
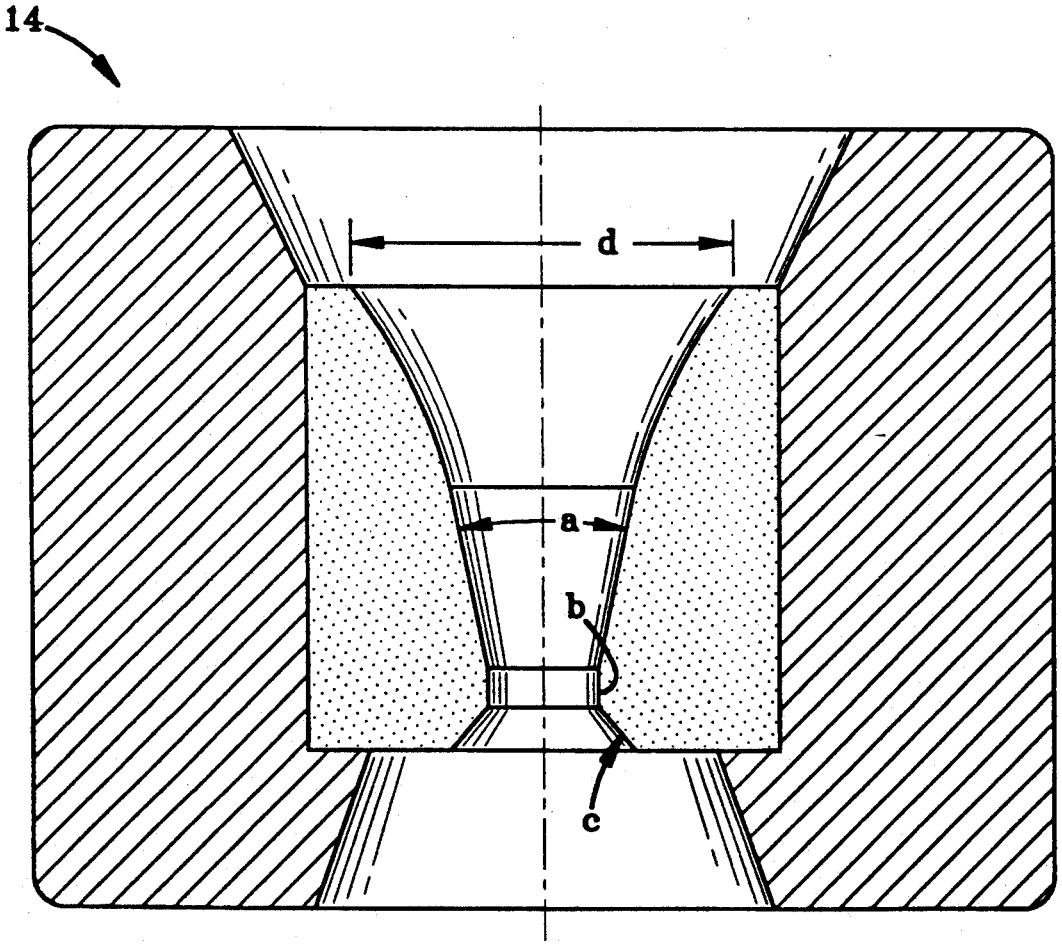
FIG. 2 is an enlarged side view of a standard die in accordance with the present invention.

FIG. 2 illustrates a standard die 14 having a die angle a, a bearing surface b, a back relief angle c and an inlet opening diameter d. Each standard die 14 has a die angle of about 8 to about 16 degrees. For the purpose of the present invention, each die 14 has a die angle of about 12 degrees. However, it is within the scope of the invention to change the geometry and angles of the die 14 to accommodate specific materials and size reductions.

The final two dies 18 and 19 are substantially identical to the standard dies with the exception of the amount of reduction taken. Each of the final two dies have a die angle of about 8 to about 16 degrees. Preferably, this die angle is about 10 to about 14 degrees. Most preferably the die angle is about 12 degrees. The specific die angle in conjunction with the cross sectional areas of inlet opening d and bearing surface b controls the amount of reduction of the cross area of the wire as it passes through the die.

The present invention and its advantages will be more fully appreciated from the following examples of the prior art method of drawing wire in contrast to the novel reduction in the final two dies, as illustrated in FIG. 1. These examples are merely for the purpose of illustration and are not to be regarded as limiting the scope of the invention or the manner in which it may be practiced.

EXAMPLE I

In this experiment, high tensile strength, steel wire having an initial diameter of 2.100 mm. was drawn through twenty one standard dies 14 and drawing capstans alternately arranged in a wire drawing device similar to device 10 but without the final two dies 18 and 19. The wire 12 passed directly from a die 14 to its drawing capstan 16 and then directly to the next die 14. The standard dies had a die angle of 12 degrees and a back relief angle of 60 degrees. At each standard die 14, the cross section of the wire was reduced by a constant reduction of about 15.5%. The steel wire was reduced to a final diameter of 0.347 mm. The percent reduction in area and the size of the wire at each die is shown in TABLE I. The resulting high tensile strength, steel wire was unstable and delamination was detected by a drop in torque.

To illustrate the deficiency in the ductility of the wire processed by the prior art method, the drawn wire was subjected to torsional testing. That is, a length of drawn wire was secured at either end. One end of the wire was turned relative to the other end, ie., twisted twenty-four, 360 degree turns.

TABLE I

| DIE NUMBER | SIZE (mm) | PERCENT REDUCTION IN AREA |
|---|---|---|
| 1 | 0.347 | 14.4 |
| 2 | 0.375 | 16.3 |
| 3 | 0.410 | 15.1 |
| 4 | 0.445 | 15.8 |
| 5 | 0.485 | 16.3 |
| 6 | 0.530 | 16.5 |
| 7 | 0.580 | 15.2 |
| 8 | 0.630 | 15.4 |
| 9 | 0.685 | 16.6 |
| 10 | 0.750 | 15.3 |
| 11 | 0.815 | 16.1 |
| 12 | 0.890 | 15.8 |
| 13 | 0.970 | 15.5 |
| 14 | 1.055 | 15.8 |
| 15 | 1.150 | 16.0 |
| 16 | 1.255 | 15.5 |
| 17 | 1.365 | 16.1 |
| 18 | 1.490 | 15.4 |
| 19 | 1.620 | 16.2 |
| 20 | 1.770 | 15.5 |
| 21 | 1.925 | 16.0 |

Figure 4:
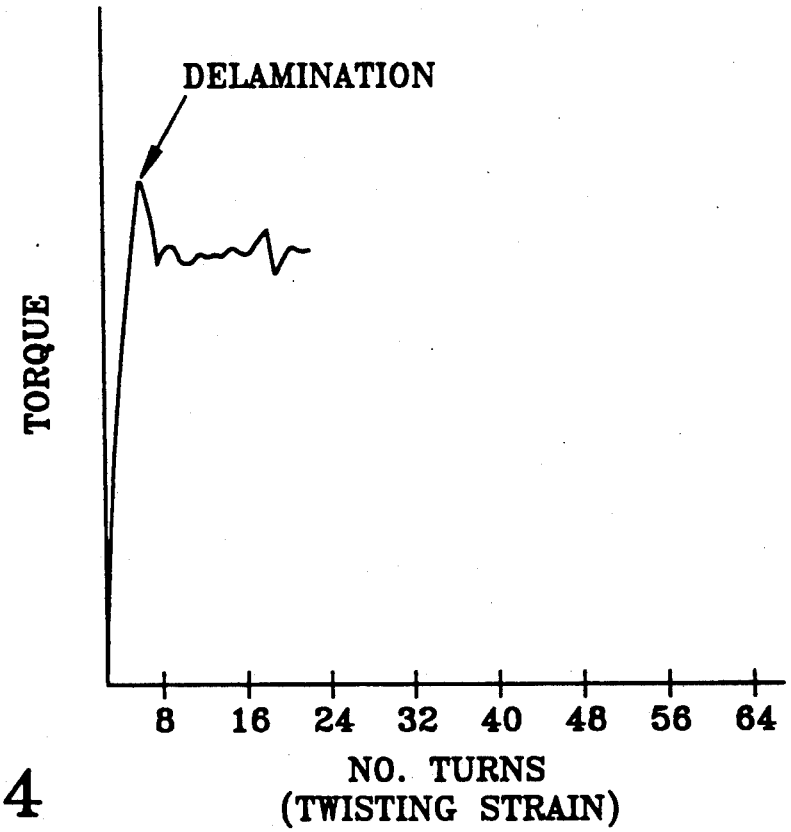
FIG. 4 is a graph illustrating longitudinal splitting of wire as a function of torque versus twists of prior art high tensile, steel wire.

As illustrated in the graph of FIG. 4, the wire was initially twisted for about three turns and the torque increased. Then the torque dropped for about three turns indicating that longitudinal splitting occurred. The torque continued to waver up and down and the now split wire was subjected to continued twisting. After about twenty four turns the wire completely fractured.

EXAMPLE II

In a second test, the wire 12, substantially identical to the wire used by the prior art apparatus and process just described, was drawn through machine 10 using the novel structure and process of the invention. That is, the machine 10 was substantially the same as the prior art machine except that the original, last standard die 14 was replaced by two dies 18 and 19. These last two dies combined take the same reduction as the single final die in the prior art apparatus. In the second test, the next to last die 18 reduced the cross section of the steel wire by about 55% of the constant reduction at the preceding, standard dies 14.

TABLE II

| DIE NUMBER | SIZE (mm) | PERCENT REDUCTION IN AREA |
|---|---|---|
| 1 | 0.347 | 6.1 |
| 2 | 0.358 | 8.9 |
| 3 | 0.375 | 16.3 |
| 4 | 0.410 | 15.1 |
| 5 | 0.445 | 15.8 |
| 6 | 0.485 | 16.3 |
| 7 | 0.530 | 16.5 |
| 8 | 0.580 | 15.2 |
| 9 | 0.630 | 15.4 |
| 10 | 0.685 | 16.6 |
| 11 | 0.750 | 15.3 |
| 12 | 0.815 | 16.1 |
| 13 | 0.890 | 15.8 |
| 14 | 0.970 | 15.5 |
| 15 | 1.055 | 15.8 |
| 16 | 1.150 | 16.0 |
| 17 | 1.255 | 15.5 |
| 18 | 1.365 | 16.1 |
| 19 | 1.490 | 15.4 |
| 20 | 1.620 | 16.2 |
| 21 | 1.770 | 15.5 |
| 22 | 1.925 | 16.0 |

Then, the final reduction of the remaining last approximate 45% occurred at the last die 19. As in the prior art example, steel Wire having an initial diameter of 2.100 mm. was reduced to a diameter of 0.347 mm. The percent reduction in area and the size of the wire at each die is shown in TABLE II. The resulting steel wire or filament was significantly improved because of its increased torsional ductility.

Figure 5:
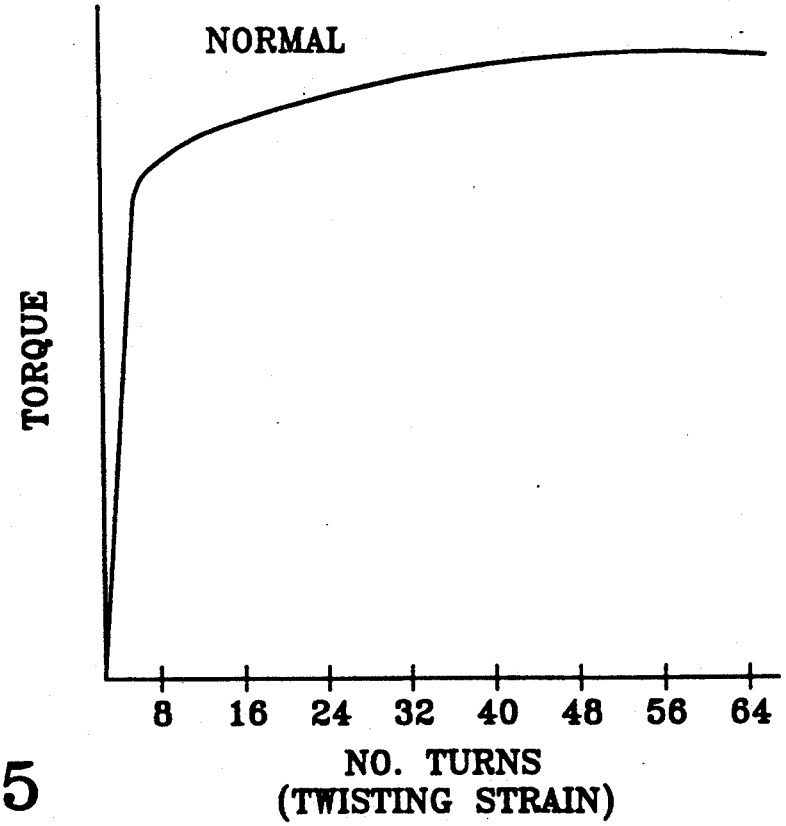
FIG. 5 is a graph illustrating longitudinal splitting of wire as a function of torque versus twists of high tensile strength, steel wire manufactured in accordance with the present invention.

The graph of FIG. 5 illustrates the average results of subjecting the wire formed by the new process and apparatus to the same test as the prior art processed wire was subjected. When a length of the wire produced by the new method and apparatus was subjected to twisting, the torque increased sharply for six, 360 degree turns. The torque then gradually increased until fracture at or about seventy six turns. This illustrates that the resulting high tensile strength, steel wire formed by the novel process of the invention has significantly increased, torsional ductility as compared with the steel wire produced in accordance with the prior art method.

Figure 3:
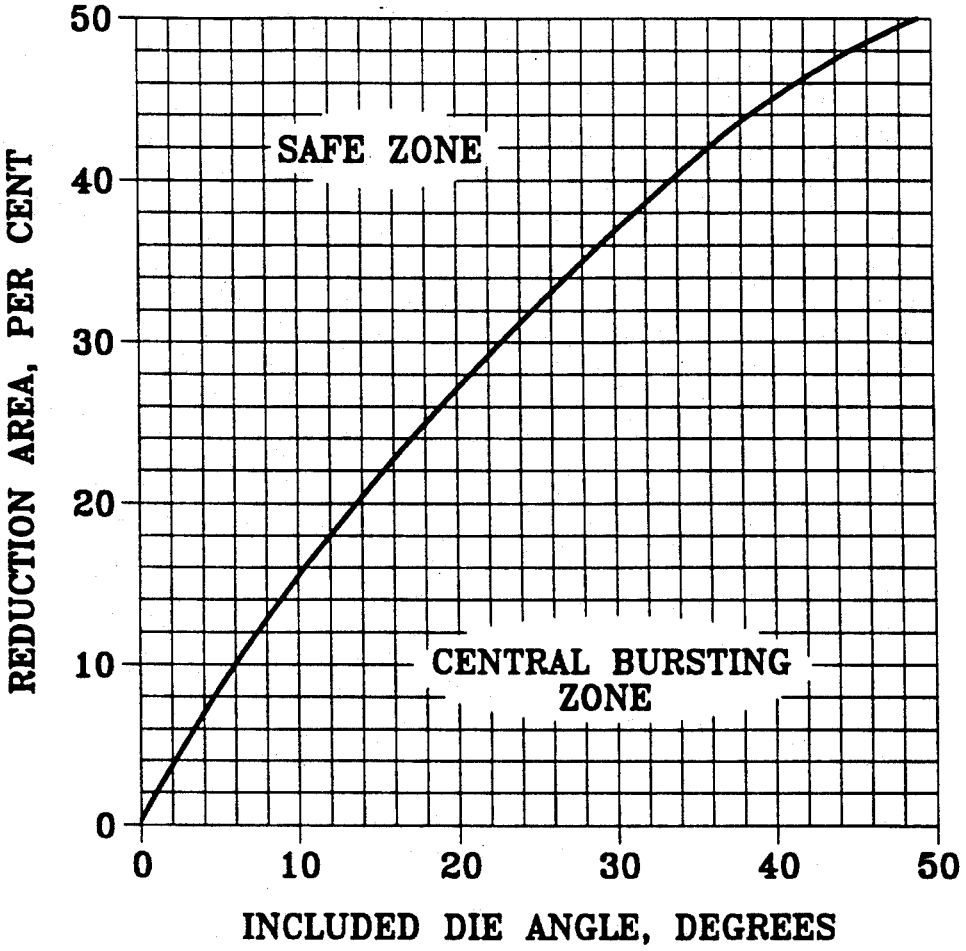
FIG. 3 is graph illustrating the safe zone and the central bursting zone as a function of the reduction in area versus the included die angle.

Using an analysis based on the prior art, as shown in FIG. 3, reducing the amount of cross sectional reduction to about 8.9 % at a die angle of about 12 degrees in the next to last die 18 results in process geometries that are in the central bursting zone. Wire made in this manner is subject to torsional failure as shown in FIG. 4. It also follows that process geometries in the central bursting zone should result in torsional failure from reducing the amount of cross sectional reduction to about 6.1% at a die angle of about 12 degrees in the final die 19. The result of drawing steel wire with the method and apparatus of the present invention, ie. high tensile strength, steel wire with increased torsional ductility, is completely unexpected.

EXAMPLE III

Figure 6:
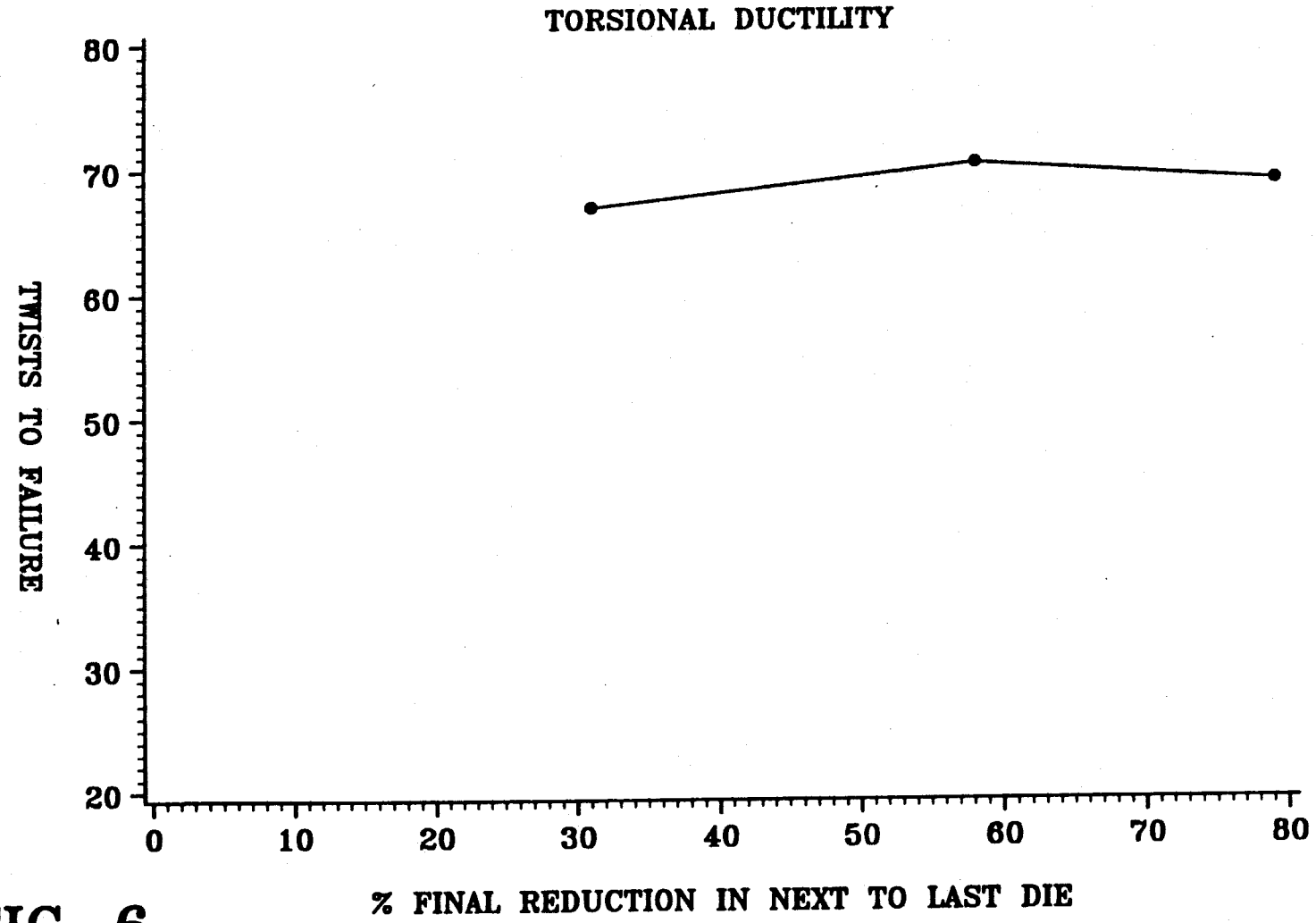
FIG. 6 is a graph illustrating torsional ductility as a function of the percent final reduction in the next to last die versus the number of twists to failure.

A further test series using a wire drawing machine set up in accordance with the present invention was run. The only change from the previously described experiment was that the reduction at the next to last die was changed to about 30% and to about 80% of the constant reduction at the standard dies. FIG. 6 is a graph illustrating the average results of these tests. With an approximate 30% final reduction (compared with the reduction at a standard die) at the next to last die, the wire withstands about sixty-five, 360 degree twists until it fails by fracture. This is a normal torsion fracture without local cracks or spiral cracks along the length of the filament. As the final reduction at the next to last die increases, as previously discussed, to about 55% (compared with the reduction at a standard die), the filament can withstand almost seventy, 360 degree twists until normal torsion fracture. The graph of FIG. 6 illustrates that when wire is subjected to a yet higher final reduction at the next to last die, ie. about 80 % (compared with the reduction at a standard die), the number of twists before normal tension fracture begins to decrease. Therefore, a reduction of about 90% of the constant reduction at the next to last die is thought to be an approximate limit before the torsional ductility is approximately equal to that resulting from the prior art processing. The results of twisting a steel wire manufactured in accordance with the first embodiment of the present invention as illustrated in FIG. 6 can be compared with the results of twisting a wire of the same size but manufactured by the prior art method as illustrated in FIG. 4, discussed before. In FIG. 6, when the final reduction in the next to last die is 35 between about 30% and 80%, the number of twists to failure remains about 60. By contrast, as shown in FIG. 4, the wire processed in accordance with the prior art method began to delaminate after about 6 turns. It is evident that the method and apparatus disclosed forms high tensile strength, steel wire having improved torsional ductility.

Figure 7:
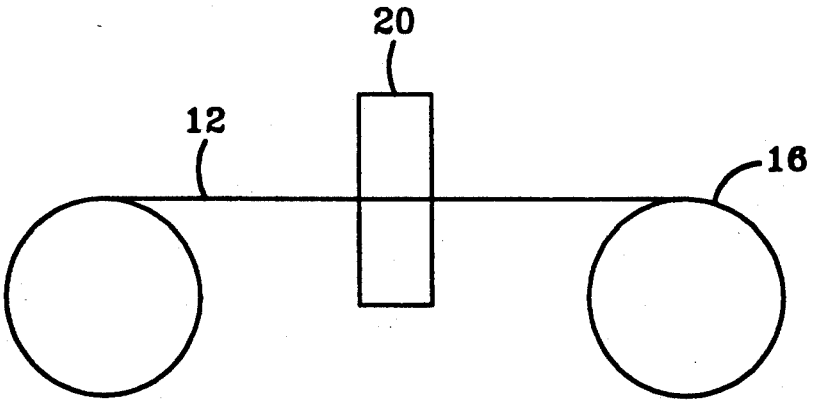
FIG. 7 is a schematic illustration of a second embodiment of the present invention wherein the final die reduces the cross section of the wire by an amount substantially less than the reduction of a single preceding standard die.

A second embodiment, incorporating the apparatus and method of operating the apparatus as illustrated in FIG. 7, is thought to be effective for producing high tensile strength, steel wire with increased torsional ductility. The second embodiment is similar to the first embodiment except that all of the dies in the draft are standard dies with a constant reduction with the exception of the last die 20. The reduction of the wire at the final die 20 is between about 10% to about 90% of the constant reduction. Preferably, about 30% to about 70% of the constant reduction is taken at final die 20. Most preferably, about 55% of the constant reduction is taken at the final die. It is believed that steel wire processed with the apparatus of the second embodiment provides the high tensile strength and increased torsional ductility of the steel wire produced in accordance with the first embodiment. The reduction at each of the standard dies is slightly more than the reduction of the standard dies in the first embodiment. Then, the same number of standard dies can be used as in the first embodiment to achieve the same total reduction in the cros sectional area of the wire.

While the present invention is directed to a wire drawing machine incorporating a straight draft, it is also within the terms of the present invention to substitute a wire drawing machine having a tapered draft. The advantage of a tapered draft is that the cross sectional area of the wire is reduced in a fewer number of dies. With a tapered draft, the amount of reduction in cross section of the wire would be larger at the first dies than with the dies in the constant draft. The amount of reduction at each draft would then become increasingly less until the last few dies. As previously discussed, the process geometries, such as the amount of reduction in each die and the die angle would still be carefully controlled to avoid falling within the central bursting zone of FIG. 3.

It is apparent that there has been provided in accordance with this invention a method and apparatus of drawing metal wire to produce high tensile strength, steel wire with increased torsional ductility that satisfy the objects, means and advantages set forth hereinbefore. While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A method of drawing steel wire to produce high tensile strength, steel wire with increased torsional ductility, comprising the steps of:
   a. drawing wire through a plurality of standard dies followed by a next to last die and a final die arranged in a wire drawing device;
   b. reducing the cross section of the wire by a constant reduction of about 15% to about 18% at each of the plurality of standard dies; and
   c. reducing the wire at said final die and said next to last die of said wire drawing device by a total amount to equal said constant reduction wherein the reduction at the next to last die is between about 10% to about 90% of the constant reduction and the remainder of the reduction is at the final die.

2. The method of drawing metal wire of claim 1 wherein the step of reduction at the next to last die is preferably about 30% to about 70% of said constant reduction and the remainder of the reduction is at the final die.

3. The method of drawing metal wire of claim 2 wherein the step of reduction at the next to last die is preferably about 55% of said constant reduction and the remainder of the reduction is at the final die.

4. The method of drawing metal wire of claim 1 wherein the step of reducing the cross section of the wire by a constant reduction at the plurality of standard dies is preferably by a constant reduction of about 15.5%.

5. An apparatus for drawing steel wire to produce high tensile strength, steel wire with increased torsional ductility, comprising:
   a. a plurality of standard dies followed by a next to last die and a final die arranged in a wire drawing device;
   b. each of said plurality of standard dies reduces the cross section of the wire by a constant reduction of about 15% to about 18%; and
   c. said next to last die and said final die in said wire drawing device reducing the cross section of the wire by a total reduction substantially equal to the constant reduction, said next to last die reducing the cross section of the wire by a reduction of about 10% to about 90% of the constant reduction and the remainder of the cross section being reduced at said final die.

6. The apparatus for drawing metal wire of claim 5 wherein the next to last die reduces the cross section of the wire to about 30% to about 70% of the constant reduction.

7. The apparatus for drawing metal wire of claim 6 wherein the next to last die reduces the cross section of the wire to about 55% of the constant reduction.

8. The apparatus for drawing metal wire of claim 7 wherein each of said plurality of standard dies reduces the cross section of the wire by a constant reduction of about 15.5%.

9. A method of drawing steel wire to produce high tensile strength, steel wire with increased torsional ductility, comprising the steps of:
   a. drawing wire through a plurality of standard dies followed by a final die arranged in a wire drawing device;
   b. reducing the cross section of the wire by a constant reduction of about 15% to about 18% at each of the standard dies; and
   c. reducing the cross section of the wire at said final die by a reduction of about 10% to about 70% of the constant reduction.

10. The method of drawing metal wire of claim 9 wherein the step of reducing the wire at the final die is preferably about 30% to about 70%of the constant reduction.

11. The method of drawing metal wire of claim 10 wherein the step of reducing the wire at the final die is most preferably about 55% of the constant reduction.

12. The method of drawing metal wire of claim 9 wherein the sep of reducing the cross section of the wire by a constant reduction at the plurality of standard dies is preferably by a constant reduction of about 15.5%.

13. An apparatus for drawing steel wire to produce high tensile strength, steel wire with increased torsional ductility, comprising:
   a. a plurality of standard dies followed by a final die in a wire drawing device;
   b. each of said plurality of standard dies reducing the cross section of the wire by a constant reduction of about 15% to about 18%; and
   c. said final die reducing the cross section of the wire by a reduction of about 10% to about 70% of the constant reduction.

14. The apparatus for drawing steel wire of claim 13 wherein the final die reduces the cross section of the wire to about 30% to about 70% of the constant reduction.

15. The apparatus for drawing steel wire of claim 14 wherein the final die reduces the cross section of the wire to about 55% of the constant reduction.

16. The apparatus for drawing steel wire of claim 13 wherein each of said plurality of standard dies reduces the cross section of the wire by a constant reduction of about 15.5%.

* * * * *